US006482041B1

(12) United States Patent
Yu-Feng

(10) Patent No.: US 6,482,041 B1
(45) Date of Patent: Nov. 19, 2002

(54) CARD CONNECTOR

(76) Inventor: Yen Yu-Feng, 3F, No. 18, Lane 87, Szu Yuan Rd., Hsin Chuang City, Taipei Hsien (TW)

( * ) Notice: Subject to any disclaimer, the term of this patent is extended or adjusted under 35 U.S.C. 154(b) by 0 days.

(21) Appl. No.: 09/954,545

(22) Filed: Sep. 12, 2001

(51) Int. Cl.[7] ..... H01R 24/00
(52) U.S. Cl. ..... 439/630; 439/862
(58) Field of Search ..... 439/630, 636, 439/260, 267, 862, 326

(56) References Cited

U.S. PATENT DOCUMENTS 6,079,988 A * 6/2000 Hashiguchi et al. ..... 439/862

* cited by examiner

*Primary Examiner*—Tho D. Ta
(74) *Attorney, Agent, or Firm*—W. Wayne Liauh

(57) ABSTRACT

A card connector is designed for a memory card to connect thereto. The card connector includes a plurality of terminals, each of which has an inner contacting end provided with serially arranged contacts, so that the memory card inserted into the card connector is in contact with each terminal at multiple points to ensure stable transmission of electric current and signals via the card connector. The card connector is also provided at a top of its casing with at least two elastic restraining legs that apply a restraining force on the memory card inserted into the connector while provide good damping effect, so that a reliable transmission of electrical signals via the card connector can be ensured even the memory card is used in a vibrating environment.

1 Claim, 3 Drawing Sheets

CARD CONNECTOR

BACKGROUND OF THE INVENTION

The present invention relates to a card connector for connecting a memory card to a computerized product, and more particularly to a card connector that ensures good contact of a memory card inserted therein with terminals in the connector, and therefore provides reliable transmission of electrical signals between the memory card and a computerized product.

To facilitate data processing, most computer-related products are provided with a card connector for a memory card to connect thereto, so that data concerning each product may be stored in or retrieved from the memory card via the card connector. A computerized product using a memory card as a main memory thereof usually has a small volume and is portable, and is frequently operated while being held with one hand. Thus, the product is more or less subject to vibration during its operation. When the vibration is large enough to cause an instantaneous separation of the memory card from terminals in the card connector, events such as incorrect retrieval of data or failed transmission of data would occur. In fact, the memory card inserted in the card connector does not frequently vibrate seriously when the memory card is subjected to an external force. However, the separation of the memory card from any one of the terminals in the card connector would result in incorrect or failed transmission of data.

It is possible to increase the vibration resistance of the card connector by slightly increasing the elastic strength of the terminals and accordingly the pressing force applied by the terminals on the memory card. However, while the increased elastic strength of the terminals in the card connector provides the connector with enhanced electric performance, it also increases the difficulty in inserting and ejecting the memory card into and out of the card connector. What is worse is the increased elastic strength of the terminals speeds up wearing of contacts on the memory card and causes damage to the same. As a result, there is only very limited value in increasing electric performance of the card connector by changing the elastic strength of the terminals thereof.

SUMMARY OF THE INVENTION

It is therefore a primary object of the present invention to provide a card connector that ensures good contact of a memory card inserted therein with every terminals of the card connector even in a vibrating environment, so that a reliable transmission of electric signals to and from the memory card is ensured.

To achieve the above and other objects, the card connector of the present invention includes a plurality of terminals, each of which has an inner contacting end provided with serially arranged contacts, so that the memory card inserted into the card connector is in contact with each terminal at multiple points. When the memory card vibrates and its inner end in the card connector shifts up or down, it will still contact with at least one of these contacts on the terminals to ensure stable transmission of electric signals via the card connector.

The contacts serially arranged on each terminal of the card connector of the present invention have tops at slightly different heights that gradually increase from outer side toward inner side of the card connector, so that the memory card inserted in the card connector under a normal working condition would touch all the contacts on each terminal at the same time.

The card connector of the present invention is also provided at a top of its casing with at least two elastic restraining legs that apply a restraining force on the memory card inserted in the connector while provide good damping effect, so that a vibration amplitude of the memory card caused by an external force may be reduced to prevent separation of the memory card from the contacts of the terminals of the card connector.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
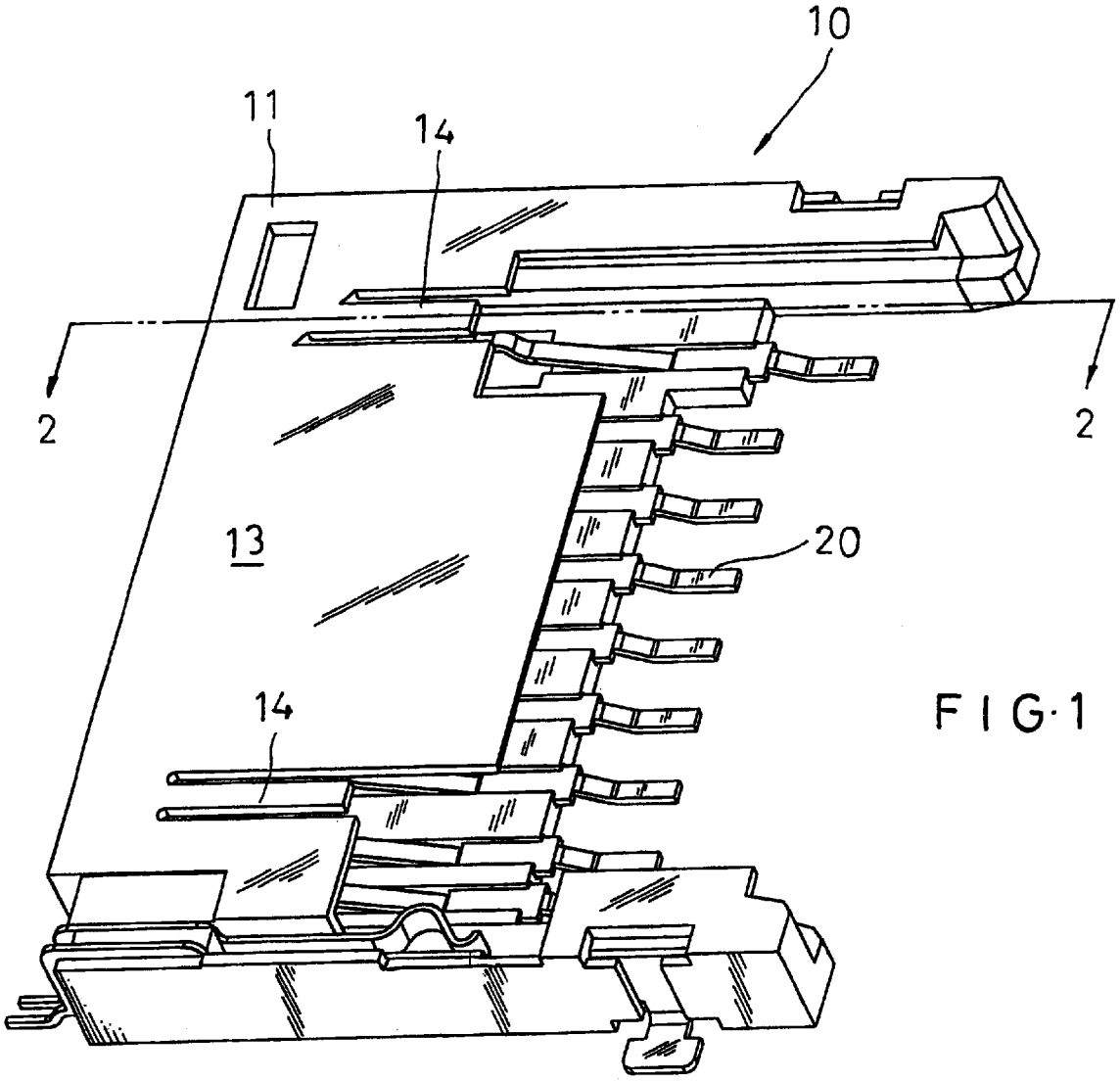
FIG. 1 is a perspective view of a card connector according to the present invention.
Figure 2:
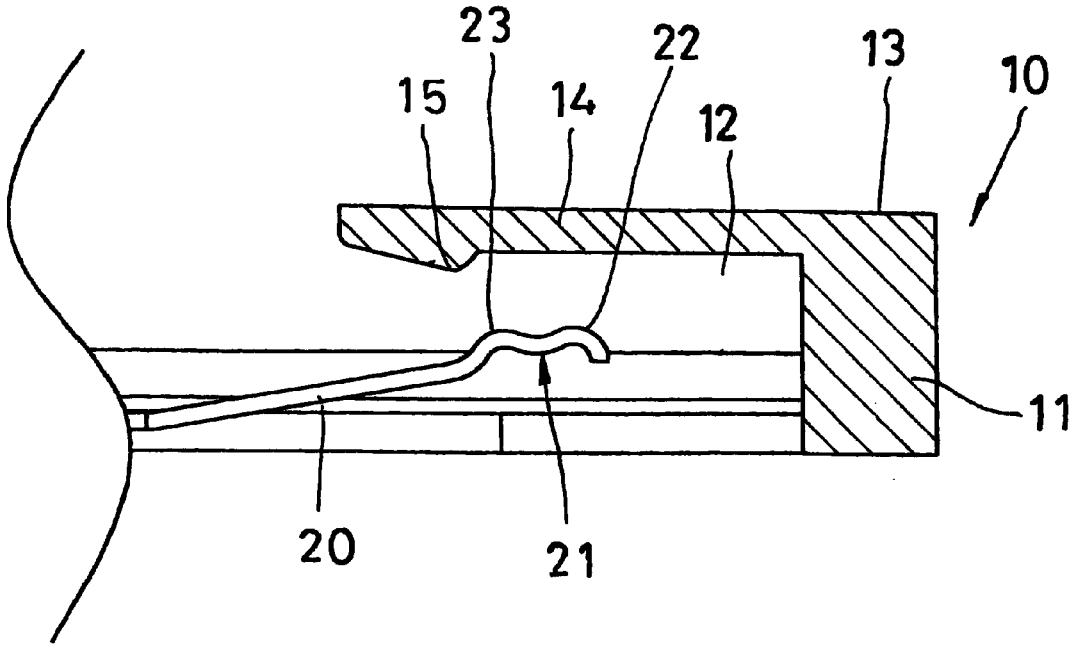
FIG. 2 is a sectional view of the card connector of the present invention taken on line 2—2 of FIG. 1.
Figure 3:
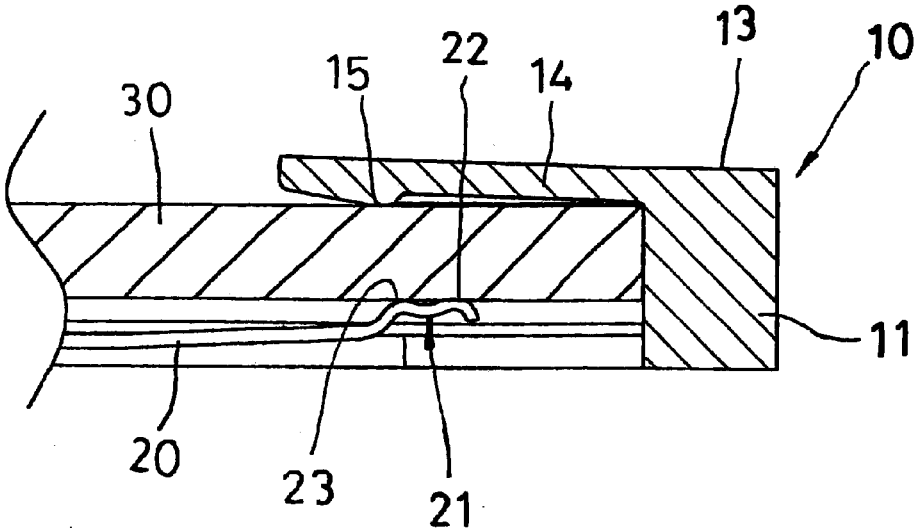
FIG. 3 is a sectional view of the card connector of the present invention having a memory card inserted therein.

Please refer to FIGS. 1 and 2 that are perspective and sectional views, respectively, of a card connector 10 according to the present invention. As shown, the card connector 10 mainly includes a casing 11 and a plurality of terminals 20 provided in the casing 11. The casing 11 defines a cavity 12 into which a memory card 30 may be inserted, as shown in FIG. 3. Each of the terminals 20 is provided at an inner contacting end 21 with a first contact 22 and a second contact 23 for contacting with the memory card 30 inserted in the cavity 12. In the illustrated figures, the first contact 22 is closer to an innermost end of the terminal 20 than the second contact 23 is, and the first contact 22 has a top slightly higher than that of the second contact 23.

When the memory card 30 is inserted into the cavity 12 in the casing 11 of the card connector 10, it first contacts with and presses against the higher first contact 22 on the inner contacting end 21 of each terminal 20, bringing the second contact 23 of each terminal 20 to shift upward and finally contact with the memory card 30, too. That is, the memory card 30 is in contact with both the first and the second contacts 22, 23 after it is fully inserted into the cavity 12 of the card connector 10.

In an ideal design for the card connector 10, the first and the second contacts 22, 23 apply the same magnitude of pressing force against the memory card 30. However, it is also practicable if the first and the second contacts 22, 23 apply two extremely close magnitudes of pressing force against the memory card 30. Parameters involved in determination of the pressing force applied by the first or the second contact 22 or 23 against the memory card 30 include height difference and distance between the first and the second contacts 22, 23, and an elastic modulus resulted from a curved section of the terminal 20 between the first and the second contacts 22, 23.

Figure 5:
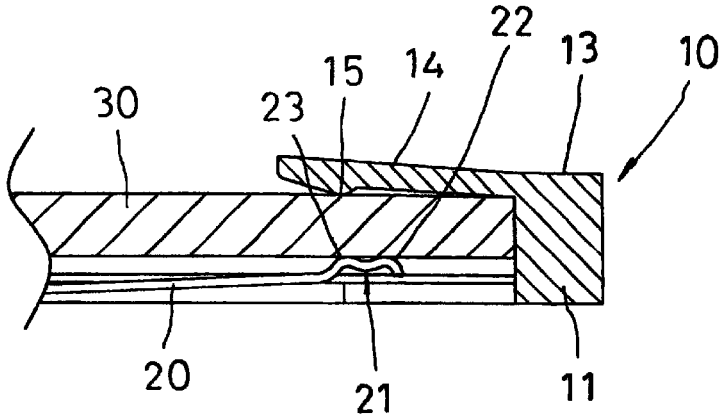
FIG. 5 shows the memory card inserted in the card connector of the present invention is in contact with both inner and outer contacts on each terminal in the connector.
Figure 6:
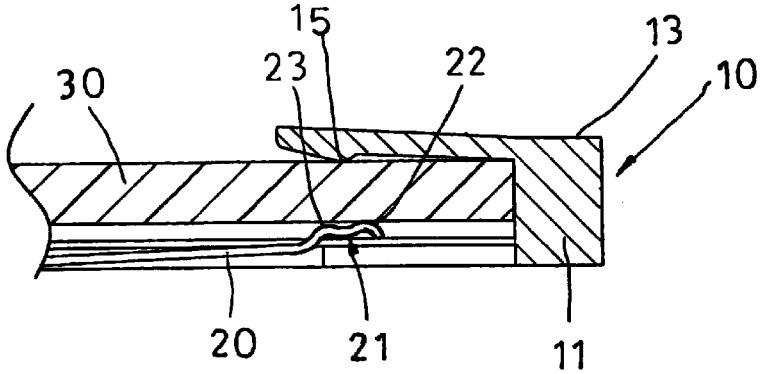
FIG. 6 shows the inner end of the memory card inserted in the card connector of the present invention does not contact with an outer contact on a terminal in the connector due to vibration.
Figure 4:
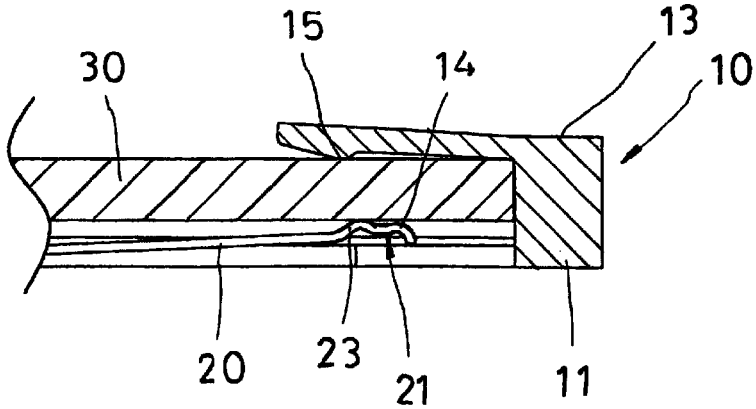
FIG. 4 shows an inner end of the memory card inserted in the card connector of the present invention does not contact with an inner contact on a terminal in the connector due to vibration.

The separation of the memory card 30 from the terminals 20 in the card connector 10 due to vibration of the memory card 30 is normally an instantaneous separation. That is, the terminals 20 would restore to a position in contact with the memory card 30 immediately after the separation. When the memory card 30 vibrates in the card connector 10 and raises a front end of the memory card 30 that is inserted into the cavity 12, the first contacts 22 of the terminals 20 instantaneously separate from the memory card 30 while the second contacts 23 keep in contact with the memory card 30, as shown in FIG. 4. Thereafter, the first contacts 22 quickly return to a state of contacting with the memory card 30, as shown in FIG. 5. And, when a rear end of the memory card 30 is raised, an instantaneous separation of the second contacts 23 of the terminals 20 from the memory card 30 will occur, as shown in FIG. 6. That is, even if the memory card 30 inserted in the card connector 10 is vibrated, it will always contact with the terminals 20 at the first and/or the second contacts 22, 23 to ensure a stable transmission of electrical signals via the card connector 10.

As can be seen from the illustrated figures, the card connector 10 is provided at predetermined positions on a top 13 of the casing 11 with two elastic restraining legs 14. A free end of each restraining legs 14 is provided at an inner side facing the cavity 12 with a protrusion 15 slightly extended into the cavity 12. When the memory card 30 is inserted into the cavity 12 of the card connector 10, as shown in FIG. 3, the elastic restraining legs 14 are slightly pushed upward by the memory card 30 and therefore apply a predetermined restraining force on the memory card 30.

When the memory card 30 in the card connector 10 is subjected to an external force and vibrates, such vibration is a high-frequency vibration having very small vibration amplitude. The protrusions 15 at the free ends of the restraining legs 14 contact with the memory card 30 and provide a damping effect to reduce the vibration amplitude of the vibrating memory card 30, protecting the memory card 30 against separation from the contacting end 21 of the terminal 20 and accordingly ensuring stable transmission of electrical signals via the card connector 10.

Parameters involved in determination of the restraining force applied by the elastic restraining legs 14 on the memory card 30 include the thickness and the length of the restraining legs 14, as well as the extent to which the protrusions 15 project from the free ends of the restraining legs 14 into the cavity 12. The restraining legs 14, due to their elasticity, are able to quickly absorb any energy that vibrates the memory card 30 and therefore largely reduce the vibration of the memory card 30, permitting the latter to keep contact with the terminal 20 in the card connector 10 and ensuring good electrical performance between the card connector 10 and the memory card 30.

The restraining force applied by the elastic restraining legs 14 on the memory card 30 also prevents the memory card 30 from direct separation and fall from the card connector 10 during an ejection operation. A user may easily get the memory card 30 out of the card connector 10.

In the above-illustrated embodiment, there are two contacts 22, 23 serially provided on the contacting end 21 of each terminal 20. Theoretically, an increased number of contacts would further ensure a good contact of the memory card 30 with the terminal 20. However, the increased number of contacts also increases the difficulty in providing identical compression strength at all contacts. Therefore, in practical implementation of the present invention, it is preferable that up to three contacts are provided on each terminal 20.

In the above-illustrated embodiment, there are two restraining legs 14 parallelly spaced on the card connector 10. In practical implementation of the present invention, the number of the restraining legs 14 may be properly increased for the card connector 10 to provide an even better vibration damping effect on the memory card 30.

In conclusion, the present invention provides a card connector that includes specially designed terminals to ensure good electrical performance of the card connector, and elastic restraining legs to provided enhanced damping effect, so that a memory card inserted in the card connector is not subject to open circuit even under a vibrating environment and good transmission of electric signals can be ensured.

What is claimed is:

1. A card connector, comprising:

a casing defining a cavity for receiving a memory card; and a plurality of terminals provided in said casing, each of said terminals having an inner contacting end located in said cavity for contacting with said memory card inserted in said cavity of said casing; and said contacting end of each said terminal including a plurality of serially arranged contacts, each of said contacts having the shape of a bend, and said bends of said contacts having tops at slightly different heights that gradually increase from outer side toward inner side of said cavity, wherein said contacting end having an elastic modulus and said serially arranged contacts are constructed such that said memory card received by said card connector is normally in contact with the innermost contact;

further wherein said casing is provided at a top thereof with at least two elastic restraining legs, and a free front end of each of said restraining legs being provided at an inner side thereof with a protrusion which extends into said cavity of said casing;

said protrusion and said plurality of contacts are positioned such that when said memory card loses contact with said innermost contact, said memory card will be in contact with another contact due to said elastic modulus of said contacting end.

* * * * *